US008118686B1

(12) United States Patent
Kurisu

(10) Patent No.: US 8,118,686 B1
(45) **Date of Patent: *Feb. 21, 2012**

(54) DEVICE FOR REDUCING EFFECT OF DOMINANT HAND ON GOLF SWING

(76) Inventor: Kazuo Kurisu, Thousand Oaks, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/925,776

(22) Filed: Nov. 1, 2010

(51) Int. Cl.
*A63B 69/36* (2006.01)

(52) U.S. Cl. ..... 473/206; 473/204

(58) Field of Classification Search ..... 473/201, 473/203, 204, 206, 219, 226, 227, 300, 302, 473/303
See application file for complete search history.

(56) References Cited

U.S. PATENT DOCUMENTS 5,762,563 A * 6/1998 Holzhausen ..... 473/206
7,591,733 B1 * 9/2009 Kurisu ..... 473/206
7,887,428 B2 * 2/2011 Kurisu ..... 473/206

* cited by examiner

*Primary Examiner* — Nini Legesse
(74) *Attorney, Agent, or Firm* — Irving Keschner

(57) ABSTRACT

A training device for use with a golf club, an elongated member enabling the device to be mounted on the grip of a golf club, the member having an inner cavity shaped to the matching surface of the grip surface. A positioner member is engaged with a post which is substantially perpendicular to the top surface of the elongated member, the height of the locking member being adjustable to accommodate the hand size of the golfer. A disc member is attached to the positioner member, the golfer's hand being positioned between the elongated member and the disc member. An adjustable wrap around lock is positioned at the end of the elongated member spaced from the post and is adjustable such that the training device can fit onto various sized grips and to be secured thereto.

5 Claims, 7 Drawing Sheets

DEVICE FOR REDUCING EFFECT OF DOMINANT HAND ON GOLF SWING

BACKGROUND OF THE INVENTION

1. Field of the Invention

The present invention provides a device attached to the grip of a golf club that reduces the effect of the user's dominant hand on his/her golf swing and at the same time helps to define the correct swing path and impact timing.

2. Description of the Prior Art

It is well known that one of the most important elements and a key to a successful golf swing is the golfer's grip. The art of positioning the fingers, hands and pressure applied to the grip has been described numerous times. In addition, there have been many devices invented for the purpose of teaching and achieving an improved golf grip or swing.

The placement of hand and fingers on grip of club is rather easily accomplished by careful observation and following instructions. But the feeling of gripping a club and the amount and placement of pressure is very difficult to describe to an individual since each interprets and feels differently.

As simple as gripping a club is, it is the most recognized and believed to be the leading cause of an inconsistent golf swing. For an efficient swing, the importance of placement of fingers and hands is fundamental. But knowing the fundamental alone does not cure problems in inconsistency; most problems may be cured by understanding how the sub-dominant and dominant hand work together.

It is known that the sub-dominant hand leads and controls the path of the golf swing. However, many golfers tend to utilize the dominant side over the sub-dominant side, consciously or unconsciously, more than necessary. This can be caused by an increase of the grip pressure, usage of wrist, turning of the hand or even the body movement. Nervousness, anxiousness, desire, lack of concentration, . . . etc. can also cause this type of problem. The actual golf swing takes a very short time from start to finish and problems can occur anytime during the swing.

What is required to overcome these mistakes is to provide a device that is simple to use and allows the user to practice conveniently as possible and not to interfere in anyway with the practice swing and to be able to compare one's own swing to the correct swing and be able to repeat the corrected swing consistently for trust and self confidence.

One of the most common and leading cause of mistake in golf is the grip. In many cases, the positioning of the hand and its pressure applied to the grip will determine the swing path and the angle of the club head, especially at the point of impact with the golf ball. A golf swing uses every part of the body sequentially and/or simultaneously in continuous motion. Therefore, when the mistake occurs during the motion, it most likely creates another mistake that leads to others. The grip connects the user's body and the club and it is one of the most important elements of the resultant golf swing. The grip has to be securely connected and at the same time, be sensitive to the club feel.

The following illustrates how the grip and pressure affects the golf swing.

A. Positioning of Fingers and Hands:

Strong grip, which promotes the dominant hand to be active and most likely closes club face at impact.

Weak grip, which promotes an open club face at impact.

B. Place of and Amount of Pressure Applied:

Excess pressure, resulting in active hands.

Dominant hand takes authority of movement.

Arm and hand dominated swing, over the top, under cutting.

Premature turning of upper body.

Decrease swing speed.

Balance control.

Reverse Pivot.

The device described in co-pending application Ser. No. 12/378,136 filed Feb. 12, 2009, provides an improved golf training device which enables the tip of a golfer's index finger to touch the grip thereby reducing the friction surface of the cylindrically shaped member; in addition, a quick release system is provided which provides a smooth surface for the golfer's hand while allowing a relatively easy and quick position adjustment.

Although the device is set forth in the '136 application functions well, a device that is thinner and simpler in design is desired.

SUMMARY OF THE INVENTION

The most common problems in having a successful golf swing is caused by an active dominant hand.

An effective golf swing requires that parts of the body be utilized differently than normally used for everyday life especially the dominant side of the body. The dominant hand has to be relaxed and the sub-dominant hand lead the swing.

The logic and theory are told and explained to the date but in reality even seasoned players occasionally make mistakes by letting the dominant hand be more active than necessary, a natural instinct of a typical golfer.

To overcome this instinct and the golf swing accordingly, the present invention provides a device attached to the golf club grip that is simple in design and simple to use. It is portable and can be used to compare the feeling of swing and correct an improper swing.

The device of the present invention provides the following advantages:

Able to go back and forth with device for quicker comparison and for better and faster learning.

Able to hit ball with device.

Better concentration for swing.

Better feel of impact zone, clearly and easy to understand body and hand position.

Better control of club head.

Better balance throughout the swing.

Better understanding of the timing of releasing the dominant side for power.

Better understanding of the role and task for the positions of the dominant hand.

Better understanding of where and what amount of pressure to apply on the grip.

Better chance to achieve, smooth and natural swing that fundamentally fits to an individual.

Exercise the proper use of power.

Exercise the feel of power transition, from leading (sub-dominant hand) to dominant hand.

Increase club head speed that leads to distance and spin to control the ball flight.

Learn role and task of sub-dominant hand.

Learn and understand the task of dominant hand.

Teaches proper movement (sequence of motion) fit to an individual's physical capabilities for the golf swing, leading to consistency and playing successful golf.

Understanding of position, angle of club head, and its affect.

The present invention will benefit all players, from beginners to advanced players.

A. For Beginners:

Ease of achieving smooth swing, which fit individual's physical capabilities.

Correct premature take-back and downswing by active dominant hand.

Learn how to use hands properly.

Utilizing sub-dominant and dominant hand the correct way.

Better feel of swing.

Better balancing, smooth, and consistent swing.

B. For Advanced Player:

Better understanding of relationship between club head and hand.

Ease of working on shot making.

Ease of correcting one's problem by themselves.

Improvement of direction, distance and timing, and for consistent and better golf.

Trusting own swing for confidence.

The training device of the present invention comprises an elongated member that enables the device to be mounted to the grip of a golf club. The member has an inner cavity tapered to fit onto the grip surface and a cutout portion formed along a portion of the device length.

A positioner member is engaged with a post which is substantially perpendicular to the top surface of the mounting member, the height of the locking member being adjustable to accommodate the hand size of the golfer. A single locking device is positioned adjacent to the end of the elongated member opposite to the post and a disc member to better support the golfer's hand is secured to the positioner in a manner which allows the disc to be tilted to different positions. The locking member is adjustable to allow the device to be coupled to different sized grips.

DESCRIPTION OF THE DRAWINGS

For a better understanding of the present invention as well as other objects and further features thereof, reference is made to the following description which is to be read in conjunction with the accompanying drawing therein:

FIG. 2(*b*) is another view of the locking mechanism;

DESCRIPTION OF THE INVENTION

For the sake of brevity, the golf training device embodiments shown in co-pending application Ser. No. 12/378,136 will not be set forth herein. However, the teachings necessary for an understanding of the present invention is incorporated herein by reference.

The present invention provides a slimmer and simpler design than the device disclosed in the '136 application, the specific details to be set forth hereinafter. In particular, the present invention provides:

More hand contact with the grip of golf club.

Post and center body components fit between the thumb and index finger of the dominant hand and every other finger has contact with the grip when the grip is held in the normal way. In effect, there is no interference between hand and club.

Better feel and direct feedback.

Attaching the device to the golf club is easier and simple;

With the cylindrical rip reduced in size, the device will be prevented from sliding on to the grip or wiggle to fitting at the position.

Positioner adjustments enables the device to be used by golfers having small hands;

More grip sizes are acceptable

A single lock wraps around the grip.

The device structure comprises:

Wide center body with an inner cavity that strengthens the center body to prevent bending;

Cylindrical portions of inner body covers approximately ⅓ of diameter of the grip;

Ribs placed at end of cylindrical portion which accept different size grips with even pressure;

Single wrap around lock is placed approximately 1" from tip of front end of the center body, which allow a secure hold and prevents the device from tipping forward and minimizing the possibility that the rear end lifts up;

Adjustable spacer is placed in middle of wrap around lock;

Accept different size grips.

Placing spacer at the center of the lock and two ribs on each end of cylindrical rip provides symmetrical pressure to the grip for better balance.

Two protrusions on back side of handle of the spacer and six dimples and two large dimples on wall of the wrap around the lock allows the spacer to be moved to one of six positions.

The spacer is pushed and snapped onto the wrap around lock.

The wrap around lock is snapped onto a lock holder.

By pushing the lock upwards; when the guide column of the wrap around lock and guide channel of the lock holder meet, the lock snapping onto the lock holder of the main body in the correct position.

Unlocking the wrap around lock is accomplished by pushing the handle of the wrap around lock in the outward direction.

The positioner used in the present invention is identical to the one disclosed in the '136 application.

A disc is added to the positioner for better hand support.

The disc has a concave channel at its center to allow fitting onto the spherical shaped positioner, enabling the disc to rotate to different angles.

The device is preferably fabricated from durable plastic.

Figure 1:
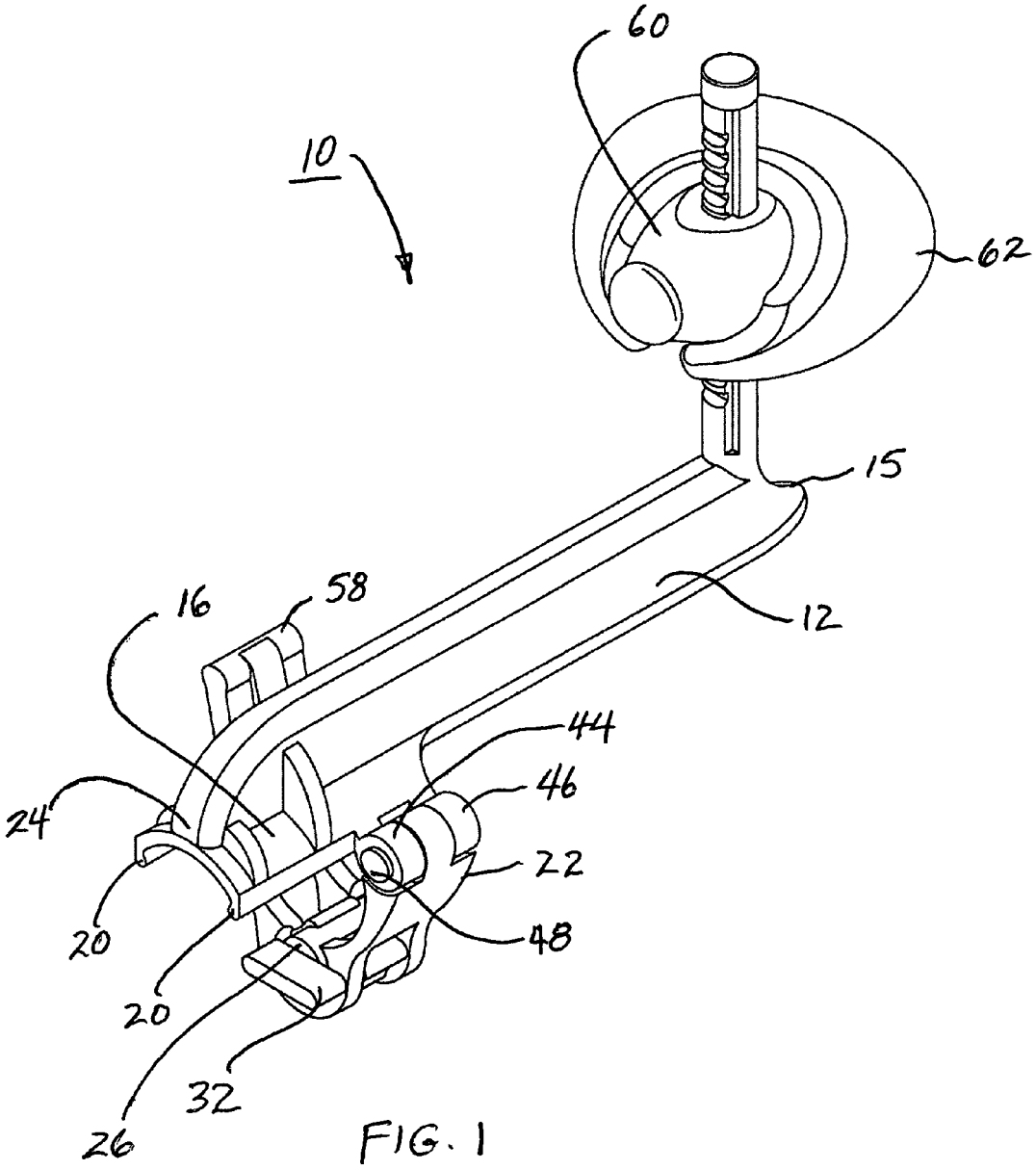
FIG. 1 is a perspective view of the device of the present invention.
Figure 2:
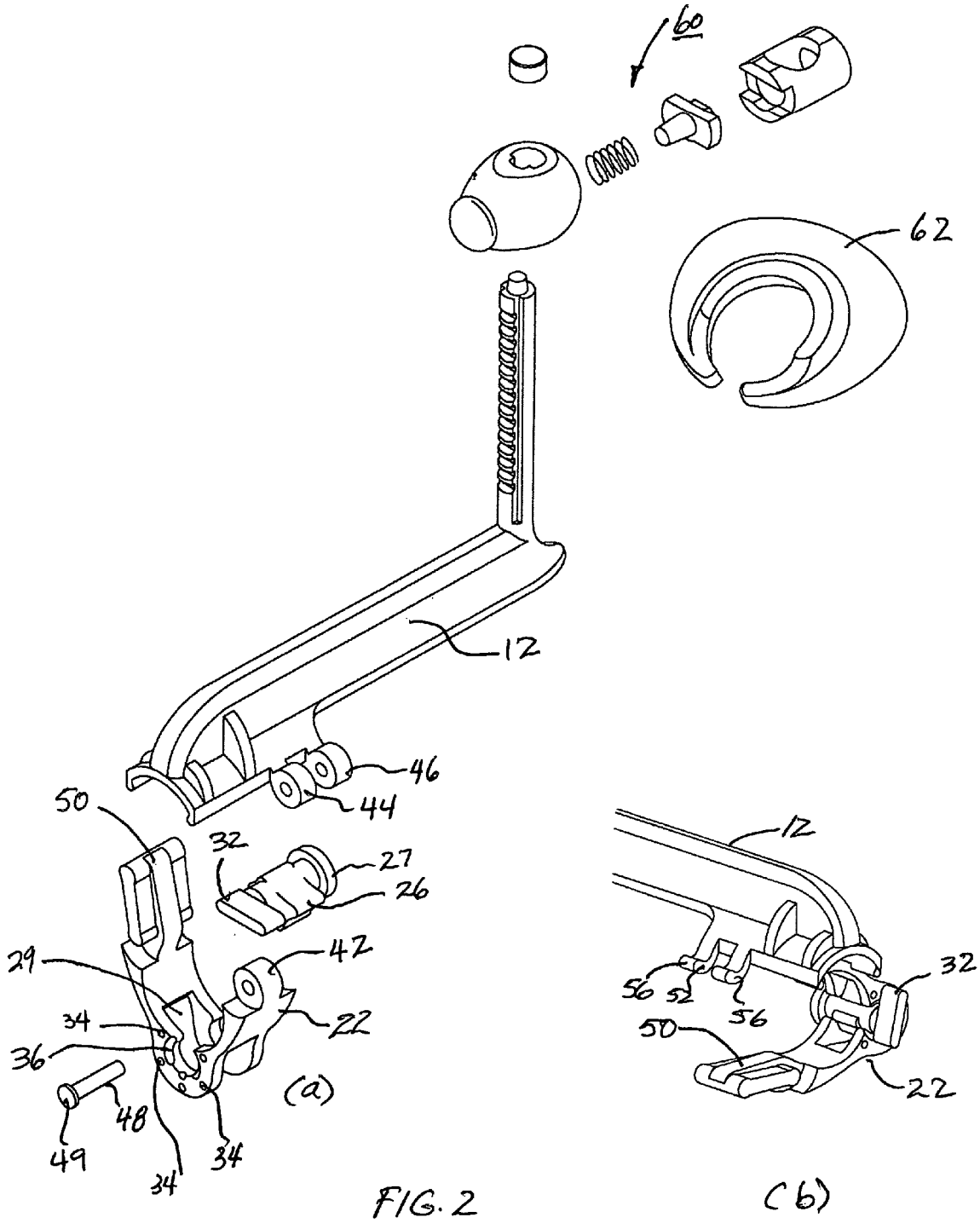
FIG. 2(*a*) shows an assembly view of the device shown in FIG. 1.
Figure 9:
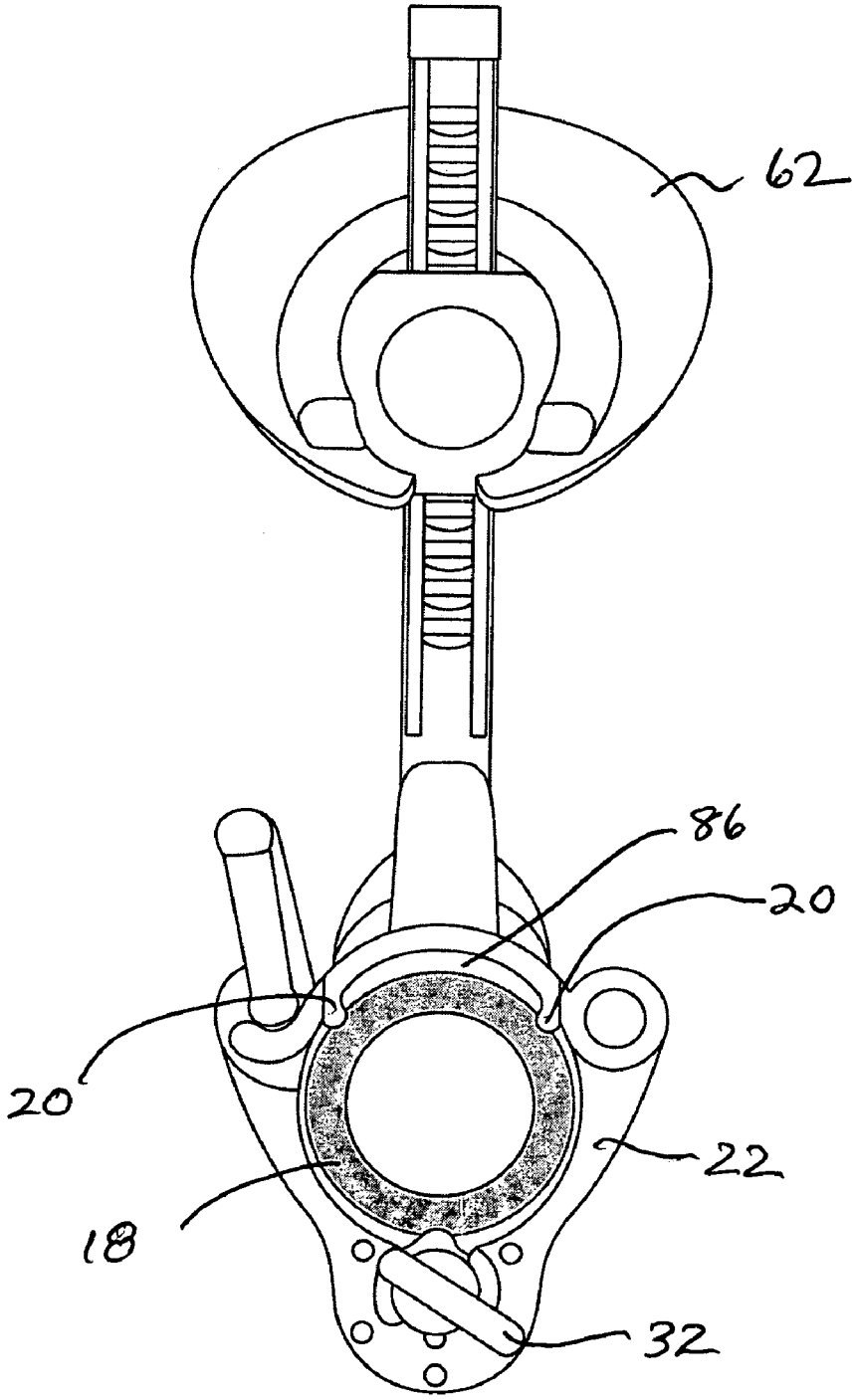
FIG. 9 illustrates how the device is secured to the golf club grip.

FIG. 1 is a perspective view of the device 10 of the present invention, FIG. 2(*a*) is an assembly view of device 10 and FIG. 2(*b*) shows a perspective view of a portion of lock 22. Device 10 comprises main elongated main inner body 12 having an inner cavity 14 (FIG. 4) to prevent bending and to minimize the overall weight of device 10. A cylindrical portion 16 of inner body 12 is sized to cover approximately ⅓ of the diameter of the golf club grip 18 (grip is illustrated in FIG. 9). Ribs 20 are positioned at the end of portion 16, the ribs engaging the outside diameter of grip 18 when lock 22 is in the locking position.

The single wrap around lock 22 is placed approximately 1 inch from the front end 24 of center body 12 which provides a secure hold on the golf grip 18. An adjustable spacer 26 is placed in the middle of lock 22 and allows device 10 to accept different diameter grips. The spacer 26, lock 22 and ribs 20 on each end of the cylindrical portion 16 provides symmetrical pressure on the grip which, in turn, provides a balanced hold for the device 10 on the grip 18. Two protrusions 30 on the back side of spacer handle 32 (FIG. 3) and five regular dimples 34, a half-dimple 35, and two large dimples 36 on the outer wall of lock 22 enables spacer 26 to rotate to one of five fixed positions and then held in place as the large dimples engage a selected position. The handle 32 of space 36 is not symmetrical and has protrusion 30 and 31 on each side. By turning handle 32 the protrusion 30 will engage with dimples 1 through 5 and the protrusion 31 will be free of friction by inside of either dimple 36. This makes it easier to turn handle 32, position to position. When handle 32 is rotated such that protrusion 31 is at the top in the open area, and will engage with dimple 35. Spacer 26 snap fits between bulges 39 and 41 and the bulges will securely hold the spacer in position. Cap member 27 guides spacer 26 to be at the selected position and prevents back and forth movement. A channel 29 is an open hole that prevents spacer 26 from rubbing against wrap around lock 22. FIG. 4A is a front view of spacer 26, the arrows pointing to six different bulge sizes for adjusting the space between the device 10 and grip 18. Spacer 26 is a separate component.

Figure 8:
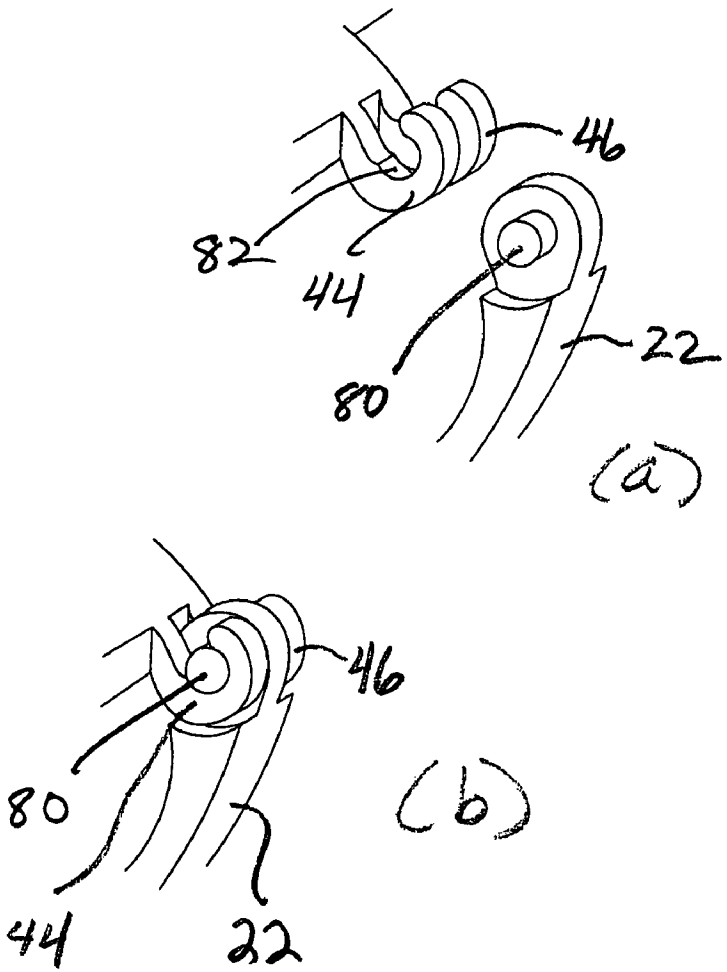
FIG. 8 illustrates an alternate way of connecting the lock to the inner body of the device.

Lock 22 is fitted into the inner body 12 and secured thereto within pin 48 (having head 49) pushed through the co-diagonal openings formed in eyelet portions 44 and 46. Referring to FIG. 2(*b*), pushing lock 22 upwards causes guide column 50 to contact channel 52, the lock 22 snapping onto lock holder 56 in the correct position. The lock 22 is unlocked by pushing handle 58 outwardly. An alternate way of securing lock 22 to inner body 12 and eliminating the necessity of requiring pin 48 is shown in FIGS. 8*a* and 8*b*. In particular, a rod 80 is molded onto lock 22. Eyelet portions 44 and 46 are designed so that one portion has an opening that allows rod 80 to squeeze through and snap fit onto eyelet, or mounting sections, 44 and 46 thereby securing lock 22 to inner body 12.

The rear portion of inner body 12 is indicated by reference numeral 15, and the distance between tip 24 and the middle of lock 22 is approximately one inch. When locking device 22 is in the locked position, rear end 15 is prevented from lifting up because of the aforementioned offset. Device 10 is secured on the grip with symmetrical pressure applied by three contact points formed by ribs 20 and one of the bulges, or protrusions, on spacer 26 when the lock 22 is in the "on" grip lock position. This arrangement prevents device 10 from moving vertically or horizontally (FIG. 9 illustrates the three contact points).

Positioner 60 is identical to the one shown in the aforementioned '136 application and for the sake of brevity, the description thereof will not be set forth herein. However, the teachings of the '136 application necessary for the understanding of the present invention is incorporated herein by reference.

Figure 3:
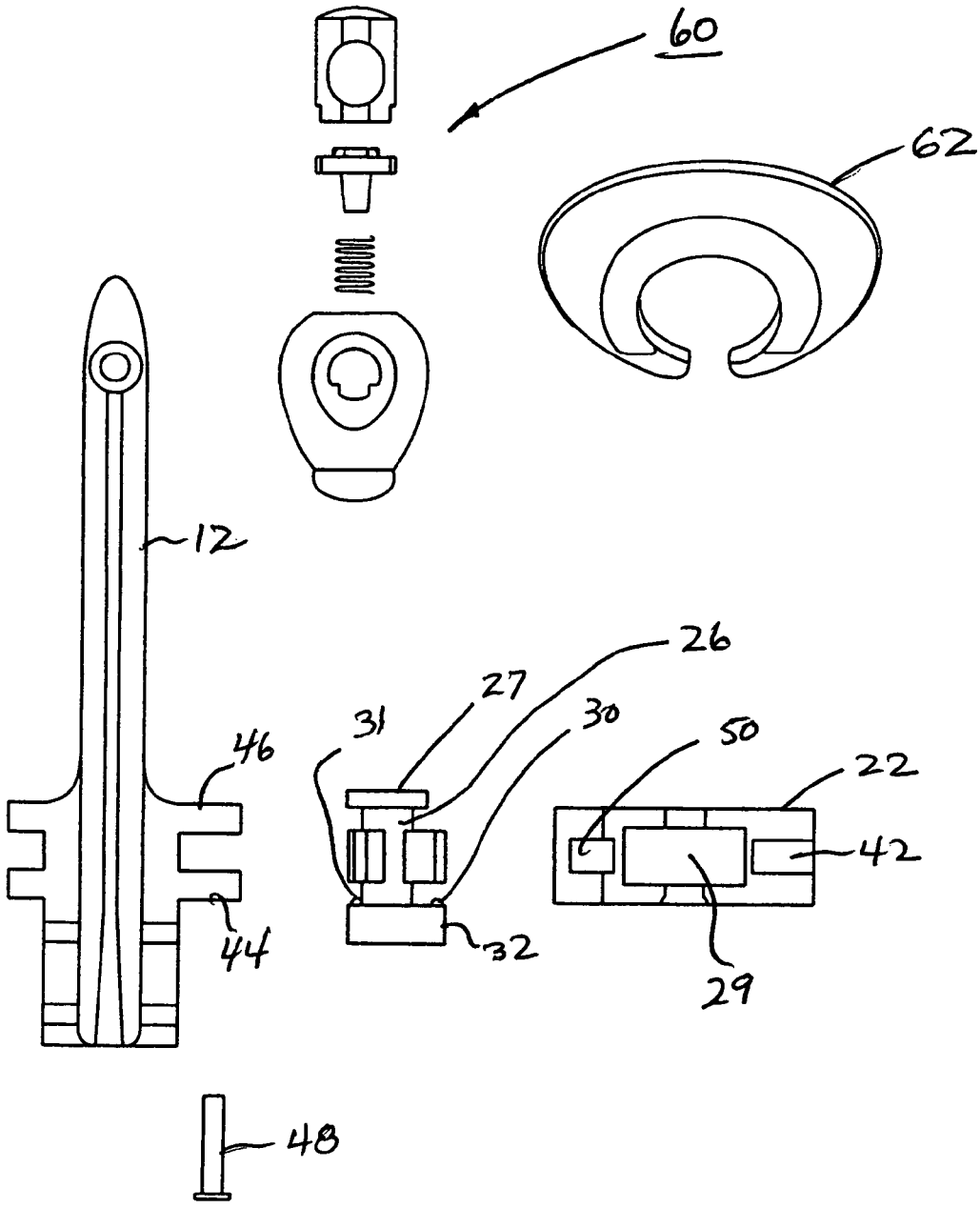
FIG. 3 is an exploded top view of the device of the present invention.
Figure 4A:
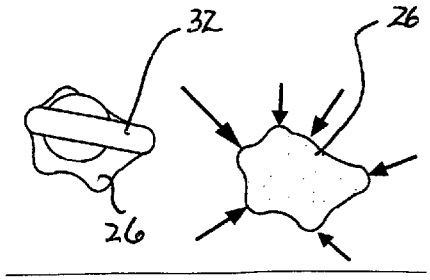
FIG. 4 is a front view of the device shown in FIG. 1.

FIG. 3 is a top view of the components that comprise device 10.

Figure 4:
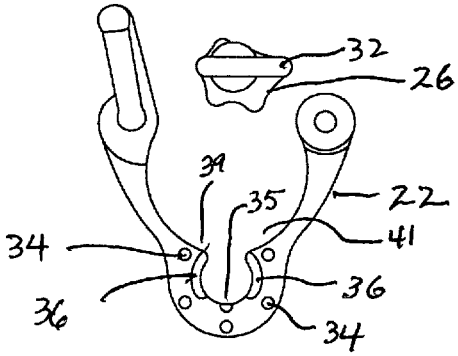

FIG. 4 is a front view of device 10 with the components disassembled and shows inner cavity 14.

Figure 5:
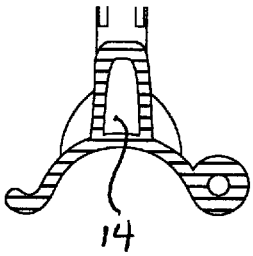
FIGS. 5(*a*)-5(*c*) shows additional details of disc 62.
Figure 5:
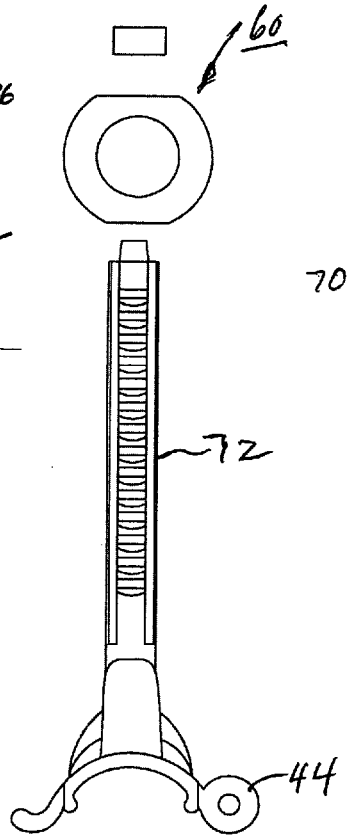
Figure 5:
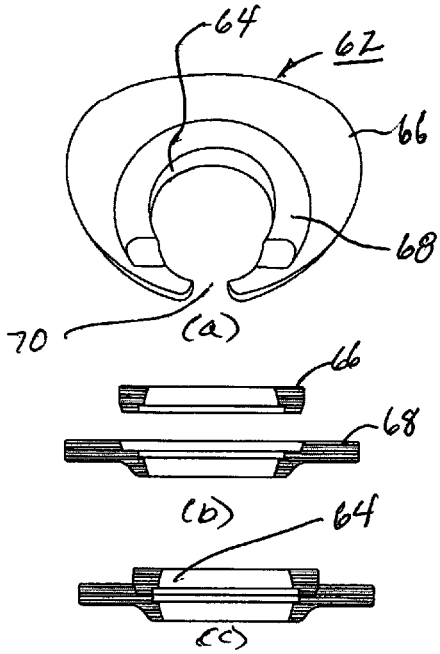

FIG. 5(*a*) shows assembled disc 62 and Figures (b) and FIG. 5(*c*) illustrate how disc 62 is fabricated.

Disc 62 is added to the positioner 60 to provide support for the golfer's hand. Disc 62 has a concave channel 64 at its center to enable it to snap fit onto the spherical shaped positioner, enabling disc 62 to be positioned at different angles for the comfort of the golfer.

Disc 62 comprises two separate parts 66 and 68 that snap together after an adhesive is applied to the parts in order to form a permanent bond resulting in the disc shown in FIG. 5(*c*). When assembled together, a concave channel 64 is formed in the middle of the assembled parts. The assembled disc has the shape of a horseshoe with an opening 70. By pushing disc 62 (opening 70) against post 72 of positioner 60 causes the disc 62 to snap onto post 72. Pushing disc 62 upward against positioned 60 causes disc 62 to snap onto post 72. To remove disc 62, a user snaps the disc downward from positioned 60 and then snaps the disc 62 outward from post 72.

Figure 6:
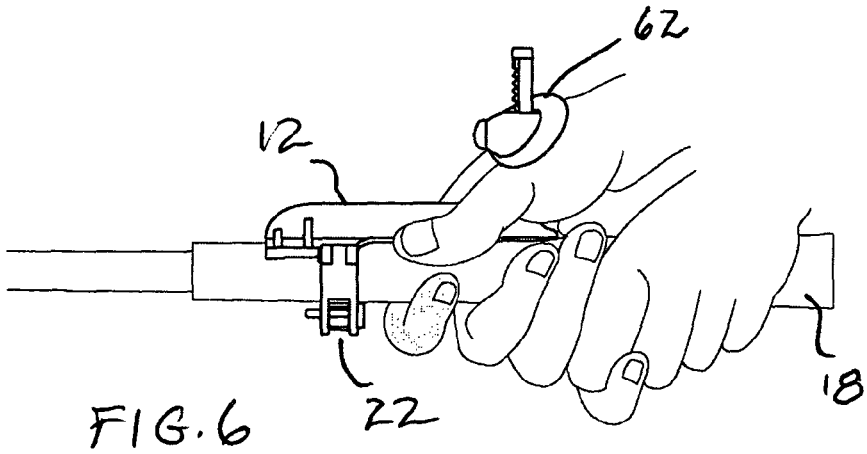
FIG. 6 is a side view of the device shown in FIG. 1 in the grip of a golfer.
Figure 7:
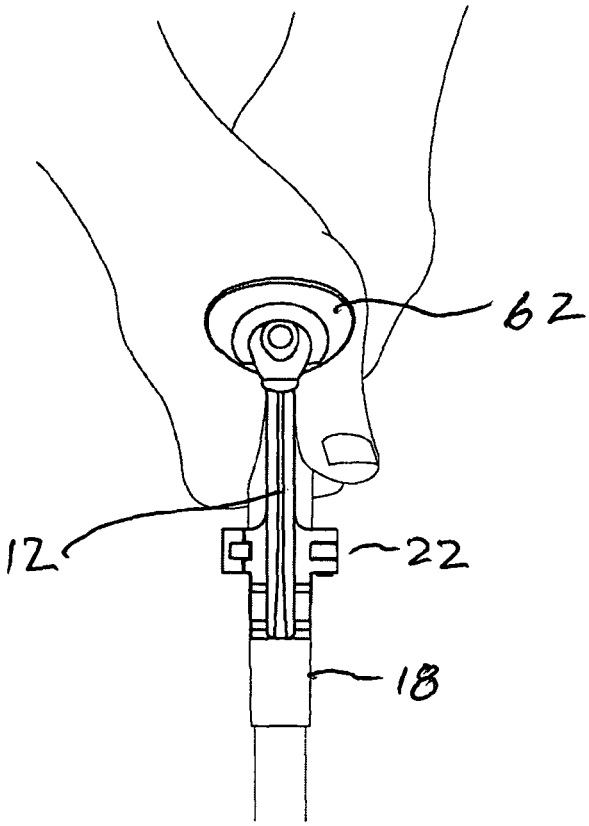
FIG. 7 is a top view of the device shown in FIG. 1 in the grip of a golfer.

FIG. 6 is a top view showing a golfer gripping device 10 and FIG. 7 is a side view showing a golfer gripping device 10.

FIG. 9 illustrates when lock 22 is operative (lock in the on position) and three contact points formed by ribs 20 and handle 32 providing symmetrical balance pressure to securely hold grip 18 in place. Note that main body 12 does not contact grip 18 in the area indicated by reference numeral 86. The contact points provide the same balance for different sized grip diameters.

Device 10 is preferably fabricated from a durable plastic.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teachings of the invention without departing from its essential teachings.

What is claimed is:

1. A device for reducing the effect of a golfer's dominant hand on his/her golf swing, said device being coupled to the grip of a golf club, comprising:

an elongated member having an interior cavity which extends along the length of said member, said member being mounted onto the grip of a golf club;

a post member;

an adjustable member operatively coupled to said post member; and a shaped member coupled to said adjustable member and positioned such that the golfer's hand positioned between the elongated member and said shaped member.

2. The device of claim 1 further including a wrap around lock positioned at an end of the elongated member and spaced from said post member, the lock being adjustable such that said device is capable of fitting onto grips of different sizes.

3. The device of claim 2 further including means to secure said lock to a selected grip.

4. The device of claim 1 wherein the angle of said shaped member with respect to said adjustable member can be altered by the golfer.

5. The device of claim 4 wherein said shaped member is a disc.

* * * * *